US012140131B2

(12) United States Patent
Brown et al.

(10) Patent No.: US 12,140,131 B2
(45) Date of Patent: Nov. 12, 2024

(54) FLANGE FOR A VACUUM APPARATUS

(71) Applicant: Edwards Vacuum LLC, Sanborn, NY (US)

(72) Inventors: Douglas Mark Brown, Shakopee, MN (US); Marcus Hans Robert Thierley, Shakopee, MN (US)

(73) Assignee: Edward Vacuum LLC, Sanborn, NY (US)

( * ) Notice: Subject to any disclaimer, the term of this patent is extended or adjusted under 35 U.S.C. 154(b) by 154 days.

(21) Appl. No.: 17/904,906

(22) PCT Filed: Feb. 18, 2021

(86) PCT No.: PCT/IB2021/051377

§ 371 (c)(1),
(2) Date: Aug. 24, 2022

(87) PCT Pub. No.: WO2021/171148

PCT Pub. Date: Sep. 2, 2021

(65) Prior Publication Data

US 2023/0113996 A1 Apr. 13, 2023

(30) Foreign Application Priority Data

Feb. 25, 2020 (GB) ..... 2002627

(51) Int. Cl.
*F04B 39/12* (2006.01)
*F04B 37/14* (2006.01)

(52) U.S. Cl.
CPC ..... *F04B 39/123* (2013.01); *F04B 37/14* (2013.01)

(58) Field of Classification Search
CPC ..... F04B 37/14; F04B 39/123
USPC ..... 417/48–51
See application file for complete search history.

(56) References Cited

U.S. PATENT DOCUMENTS 3,577,096 A * 5/1971 Bridges ..... H01S 3/036 372/83
4,616,860 A 10/1986 Faria et al.
5,640,751 A * 6/1997 Faria ..... F16L 23/20 29/888.3
5,855,118 A 1/1999 Lorimer
(Continued)

FOREIGN PATENT DOCUMENTS

CN 1109142 A 9/1995
EP 2975268 A2 1/2016
(Continued)

OTHER PUBLICATIONS

Ping Fan, Ji-guo Chu, Jian-da Shao, Conductance calculation of long tubes with rectangular cross section and annular cross section in the full pressure range, 2002, Vacuum, vol. 68, Issue 4, pp. 373-378 (Year: 2002).*

(Continued)

*Primary Examiner* — Philip E Stimpert
(74) *Attorney, Agent, or Firm* — Theodore M. Magee; Westman, Champlin & Koehler, P.A.

(57) ABSTRACT

Flange for a vacuum apparatus comprises a housing to be connected to the vacuum apparatus defining an opening wherein the opening has rectangular narrow shape. The flange further comprises a metal seal arranged around the opening to create a vacuum tight seal.

11 Claims, 2 Drawing Sheets

(56) References Cited

U.S. PATENT DOCUMENTS

| | | | |
|---|---|---|---|
| 2007/0125515 | A1 | 6/2007 | Jung et al. |
| 2008/0283745 | A1 | 11/2008 | Adamec et al. |

FOREIGN PATENT DOCUMENTS

| | | | |
|---|---|---|---|
| GB | 2538962 | A | 12/2016 |
| JP | 3966370 | B2 | 8/2007 |

OTHER PUBLICATIONS

PCT Notification of Transmittal of the International Search Report and the Written Opinion of the International Searching Authority, or the Declaration dated May 17, 2021 and International Search Report dated May 17, 2021 for corresponding PCT application Serial No. PCT/IB2021/051377, 6 pages.
British Examination Report dated Jul. 16, 2020 and Search Report dated Jul. 15, 2020 for corresponding British application Serial No. GB2002627.4, 7 pages.
PCT Written Opinion dated May 17, 2021 for corresponding PCT application Serial No. PCT/IB2021/051377, 7 pages.
Response to Written Opinion dated Dec. 20, 2021 for corresponding PCT application Serial No. PCT/IB2021/051377, 3 pages.
First Chinese Office Action dated Dec. 27, 2023 and Search Report dated Dec. 26, 2023 for corresponding Chinese application Serial No. CN202180016888.6, 7 pages.

* cited by examiner

FLANGE FOR A VACUUM APPARATUS

CROSS-REFERENCE TO RELATED APPLICATION

This application is a Section 371 National Stage Application of International Application No. PCT/IB2021/051377, filed Feb. 18, 2021, and published as WO 2021/171148 A1 on Sep. 2, 2021, the content of which is hereby incorporated by reference in its entirety and which claims priority of British Application No. 2002627.4, filed Feb. 25, 2020.

FIELD

It is an object of the present invention to provide a flange for a vacuum apparatus, a vacuum pump with such a flange and a vacuum apparatus with such vacuum pump.

BACKGROUND

In numerous industrial and scientific instruments and systems ultrahigh vacuum is required with pressures below $10^{-7}$ mbar. For the generation of such a vacuum in a vacuum apparatus it is known to use combinations of different pump types. Thus, a main pump or backing pump is used to generate pressures from last to $10^{-1}$ mbar to $10^{-3}$ mbar as low vacuum. Usually, the main pump or backing pump is combined with another vacuum pump to generate a high vacuum or even ultrahigh vacuum including pressures below $10^{-7}$ mbar. Ultrahigh vacuum pumps encompass absorption pumps in order to generate the desired pressures. This absorption pumps encompass ion getter pumps (IGP) and volume getter pumps, i.e. evaporable getter material pumps (NEG).

In particular, the vacuum pump should be placed as close as possible to the vessel in order to increase the conductance. However, due to space constraints, sometimes it is not possible to directly connect the vacuum pump with the vessel and connection pipe elements are necessary that are under some circumstance also bended. Connecting pipe element, vessel and vacuum pump must be connected by flanges placed in between, each of them reducing the conductance and consequently also the pump performance.

The discussion above is merely provided for general background information and is not intended to be used as an aid in determining the scope of the claimed subject matter. The claimed subject matter is not limited to implementations that solve any or all disadvantages noted in the background.

SUMMARY

Thus, it is an object of the present invention to provide a flange improving the conductance.

The given technical problem is solved by a flange according to claim 1, a vacuum pump according to claim 5, and a vacuum apparatus according to claim 7.

The flange for a vacuum apparatus including a vessel and a vacuum pump according to the present invention comprises a housing. The housing has a first end preferably to be connected to the vessel of the vacuum apparatus and a second end preferably to be connected to the vacuum pump of the vacuum apparatus. The housing defines an opening extending through the housing from the first end to the second end and fluidly connecting the vessel with the vacuum pump. Therein the opening has a rectangular and narrow shape. Therein narrow means that that the width of the opening is larger than the height of the opening. Rectangular also includes essentially rectangular forms or forms which at least partially have parallel sides opposite to each other. Further, the flange comprises a metal seal arranged around the opening at least at one end of the housing and preferably arranged at both ends of the housing to create a vacuum tight seal. Thus, by the rectangular and narrow shape sufficient conductance is provided by reducing the space requirements of the flange.

Preferably the opening has an aspect ratio of width to height larger than 4 and preferably larger than 10.

Preferably, the lengths of the flange from the first end of the housing to the second end of the housing is short and in particular comparable to the height of the opening. Preferably the ration of length to height is between 0.5 and 2. Thus, by the short length of the flange, the vacuum apparatus connected to the flange is placed in close proximity to the vessel or vacuum chamber thereby improving the conductance.

Preferably, the flange comprises a cutting edge interacting with a metal seal to provide a vacuum tight seal. In particular, the cutting edge is arranged at both ends of the housing. By the cutting edge, the metal seal is pinched to form a close contact between the cutting edge and the metal seal.

Preferably, the area of the opening corresponds essentially to the area of a non-evaporable getter pump (NEG) or an ion getter pump (IGP) connected to the flange or the area corresponds to the combined areas of the NEG and IGP. Thus, since the area of the opening corresponds to the respective pump elements, gas particles or molecules can easily arrive at the pump element and efficiently be pumped by the NEG and/or IGP element. No complex path or lengthy flanges must be followed to be reached the pump element and thus the performance is enhanced.

Further, the present invention relates to a vacuum pump with a flange, wherein the flange comprises a housing having a first end connected to the vacuum pump and a second end preferably to be connected to a vacuum apparatus, i.e. a vessel or vacuum chamber. Therein, the housing defines an opening going through the housing from the first end to the second end thereby fluidly connecting the vessel with the vacuum pump. In particular, the opening has a rectangular and narrow shape and preferably the opening has an aspect ratio of width to height of the opening larger than 4 and preferably larger than 10. Further, the vacuum pump comprises a NEG and/or IGP element, wherein the NEG or IGP element is directly attached to the flange. Thus, no additional elements are placed and are necessary in-between the NEG and/or IGP element and the flange.

Preferably, the NEG and/or IGP element is at least partially disposed directly within the opening of the flange. Thereby the distance between the NEG and/or IGP element to the vacuum chamber can be further reduced also reducing the space requirements of the vacuum pump. Thus, the vacuum pump can be placed in close proximity to the vacuum camber or vessel enhancing the conductance and also enhancing, as a consequence, the pump performance of the NEG and/or IGP element.

Preferably the flange is build as previously described.

Further, it is an object of the present invention to provide a vacuum apparatus comprising a vacuum pump as previously described wherein the vacuum pump is directly connected to a vessel by the flange of the vacuum pump. Thus, no further elements are placed in-between the vacuum pump and the vessel in order to enhance to conductance. Further, by this configuration the distance between the vacuum pump and the vessel can be reduced further improving the conductance and reducing the space requirements.

Preferably, the vessel is a tube or pipe in particular a beam tube of an e-beam apparatus or any other kind of particle accelerator, wherein the vacuum pump is arranged along the axial direction of the pipe, i.e. the width of the opening of the flange is along the axial direction of the pipe. Thus, the flange can be directly connected to the vessel, i.e. the tube, providing a short distance between the vacuum pump and the vessel.

The summary is provided to introduce a selection of concepts in a simplified form that are further described in the detailed description. This summary is not intended to identify key features or essential features of the claimed subject matter, nor is it intended to be used as an aid in determining the scope of the claimed subject matter.

BRIEF DESCRIPTION OF THE DRAWINGS

In the following the present invention is described in more detail with reference to the embodiments in the accompanied drawings.

It is shown.

DETAILED DESCRIPTION

Figure 1:
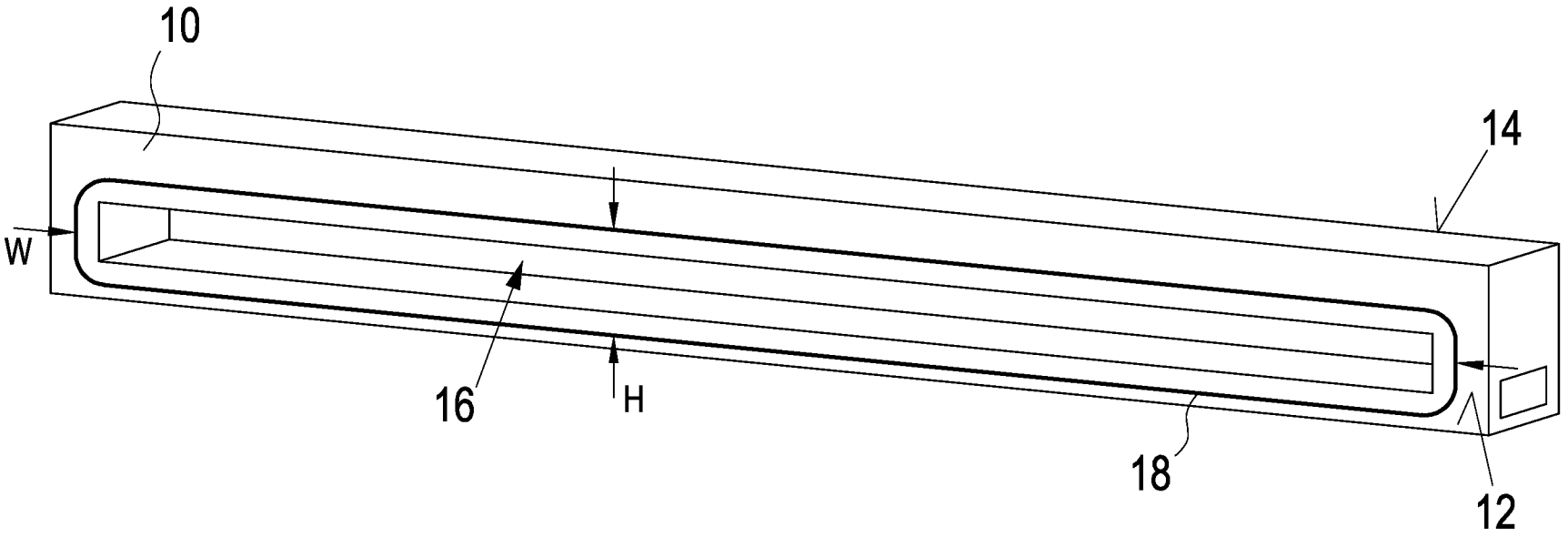
FIG. 1 an embodiment of a flange in accordance to the present invention.

FIG. 1 shows a flange in accordance with the present invention comprising a housing 10 with a first end 12 and a second end 14, wherein the housing can be connected for example to a vessel or vacuum chamber with the first end 12 and can be connected for example to vacuum pump by the second end 14.

In the housing 10 an opening 16 is provided extending from the first end 12 to the second end 14 wherein a gaseous medium, gas particles and molecules can be conveyed through the opening from the first end 12 (i.e. the vessel) to the second end 14 (i.e. the vacuum pump) or in the opposite direction. Thus, by the opening 16 a fluid communication between the vacuum pump and the vessel is provided.

As shown in FIG. 1 the opening 16 has a rectangular and narrow shape. Thus, the widths W of the opening 16 is much larger than the height H of the opening 16. In particular, the ratio of width to height W/H is larger than 4 and preferably larger than 10. Thus, by this narrow and rectangular shape of the opening 16, a sufficient area is provided to increase or at least maintain the conductance while decreasing the spatial requirements of the flange. Due to the small space requirements of the flange, the vacuum pump connected to the flange can be placed in close proximity to the vessel enhancing the conductance and therefore also enhancing the pump performance of the connected vacuum pump.

In order to provide vacuum tight connection to the flange, the housing 10 comprises a metal seal 18 arranged around the opening 16 preferably at the first end 12 and also the second end 14. Further, the housing 10 comprises a cutting edge incising the metal seal in order to provide the vacuum tight seal. Therein, the connected vacuum pump or vessel also comprises a cutting edge simultaneously incising the metal seal to provide a vacuum seal between the vessel or vacuum pump with the flange, respectively.

Figure 2:
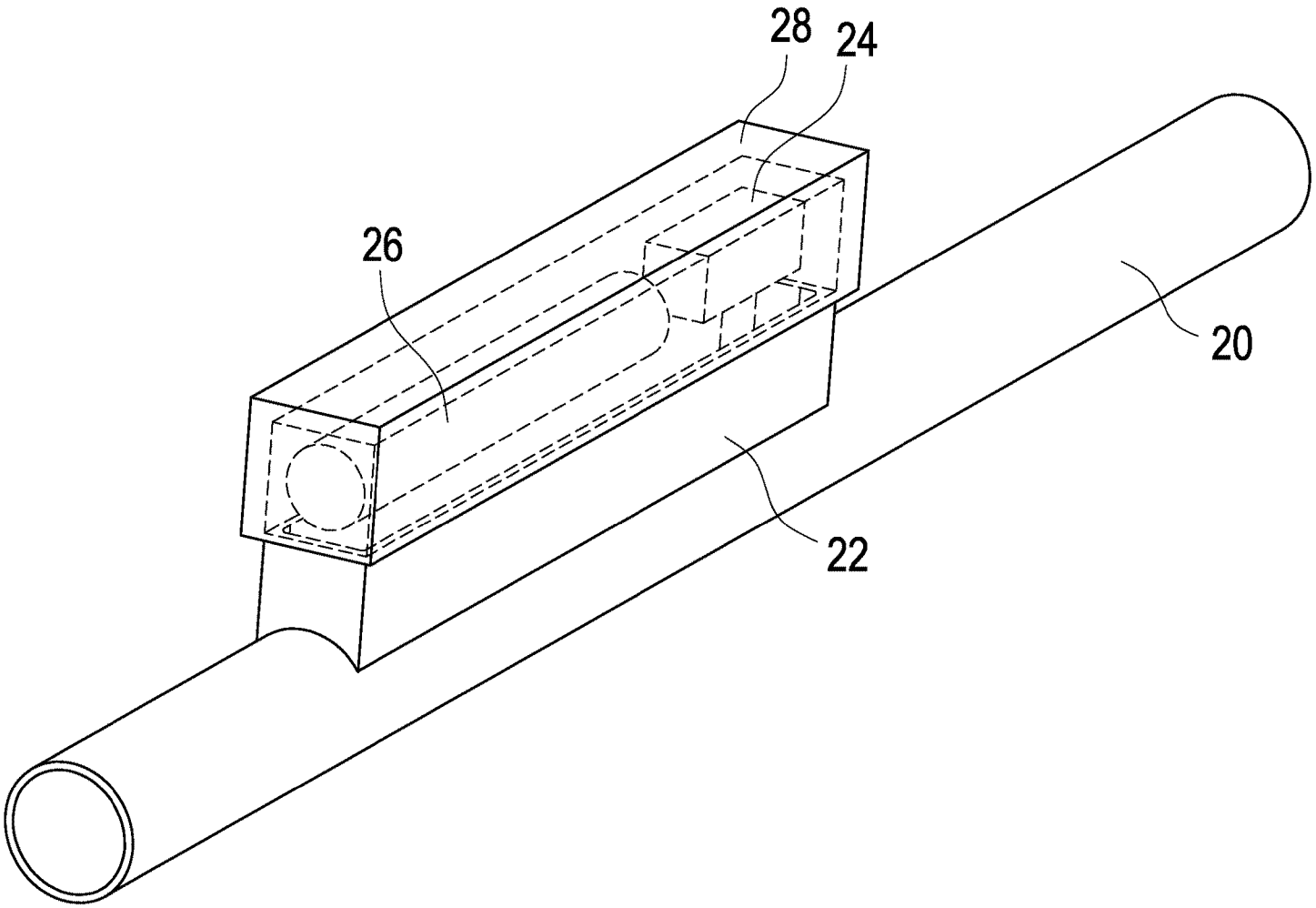
FIG. 2 a vacuum apparatus in accordance to the present invention.

FIG. 2 shows a vacuum apparatus in accordance with the present invention. The vacuum apparatus comprises a vessel 20 build as tube or pipe in particular build as beam pipe for an e-beam apparatus or any other kind of particle accelerator. A flange 22 is connected to the vessel 20 as described with respect to FIG. 1. Therein the flange 22 is arranged in an axial direction of the vessel 20, i.e. the width W of the flange 22 is arranged along the axial direction of the tube. Also, the height H of the flange is in correspondence to the diameter of the tube. With the second end 14 of the flange 22 an IGP element 24 and a NEG element 26 as vacuum pump 28 are connected, schematically indicated in FIG. 2. Therein, the area of the opening 16 of the flange 22 corresponds to the combined area of NEG element 26 and the IGP element 24. Thus, by the flange 22 the vacuum pump 28 can be placed in close proximity to the vessel 20 due to the inventive form of the flange 22. In particular, the conductance between the vessel 20 and the vacuum pump 28 is enhanced by the flange 22 since the gas particles and molecules need not to follow a complex and lengthy path to the vacuum pump 28 but can directly arrive at the vacuum pump 28 and being pumped by the IGP element 24 or the NEG element 26.

Thus, by the present invention a compact way of connecting a vacuum pump to a vessel of a vacuum apparatus is provided reducing the space requirements of the vacuum pump and flange such that the vacuum pump can be placed close to the vessel enhancing the conductance between vessel and vacuum pump and thereby enhancing the pump performance.

Although elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are described as example forms of implementing the claims.

The invention claimed is:

1. A vacuum apparatus comprising:
- a vacuum pump housing;
- a flange comprising:
  - a first end configured to connect to a vessel;
  - a second end connected to the vacuum pump housing; and
  - an opening extending between the first end and the second end and having a width and a height at the second end wherein the ratio of the width to the height is larger than 4;
- a NEG element in the vacuum pump housing;
- an IGP element in the vacuum pump housing;
- characterized in that both the NEG element and the IGP element are positioned along the width of the opening, further wherein both the NEG element and the IGP element are directly attached to the flange such that no additional elements are placed between the NEG element and the vessel or between the IGP element and the vessel.

2. The flange according to claim 1, characterized in that the opening has an aspect ratio of width to height larger than 10.

3. The flange according to claim 1, characterized in that the flange comprises a cutting edge interacting with a metal seal to provide a leaktight seal with the vessel.

4. A vacuum apparatus comprising:
- a vacuum pump housing;
- a flange comprising:

a first end configured to connect to a vessel;

a second end connected to the vacuum pump housing;

an opening from the first end to the second end, the opening having a width and height at the second end wherein the ratio of the width to the height is greater than four; and at least one sputtering pump element having a first dimension and a second dimension positioned within the pump housing, wherein the first dimension is greater than the second dimension, and the first dimension extends along the width of the opening and the second dimension extends along the height of the opening further wherein a vacuum pump is directly attached to the flange such that no additional elements are placed between the vacuum pump and the vessel.

5. The vacuum apparatus of claim 4 wherein the ratio of the width to the height is greater than 10.

6. The vacuum apparatus according to claim 4, characterized in that the vessel is a tube having a diameter and extending along an axis of the tube and the first end of the flange is configured to connect to the tube such that the width of the opening at the second end is parallel to the axis of the tube.

7. A vacuum apparatus comprising:

a vacuum pump; and a flange comprising:

a first end connected to the vacuum pump;

a second end configured to be connected to a tube having a diameter and extending along an axis; and an opening extending between the first end and the second end, the opening having a width and a height at the second end with the width being greater than the height and the second end configured to be connected to the tube such that the width of the opening is parallel to the axis of the tube wherein the vacuum pump is directly attached to the flange such that no additional elements are placed between the vacuum pump and the vessel and further wherein the ratio of the width to the height is larger than 4.

8. The vacuum apparatus of claim 7 wherein the vacuum pump comprises a NEG element positioned at the opening of the flange.

9. The vacuum apparatus of claim 7 wherein the vacuum pump comprises an IGP element positioned at the opening of the flange.

10. The vacuum apparatus of claim 7 wherein the vacuum pump comprises both a NEG element and an IGP element and both the NEG element and the IGP element are positioned at the opening of the flange.

11. The vacuum apparatus of claim 7 wherein the ratio of the width to the height is greater than 10.

* * * * *